United States Patent [19]

Coyne et al.

[11] 4,390,225

[45] Jun. 28, 1983

[54] FUSE BLOCK ASSEMBLY

[75] Inventors: Kevin N. Coyne, Georgetown; Hazen Curtis, III, Andover, both of Mass.

[73] Assignee: Bell Telephone Laboratories, Incorporated, Murray Hill, N.J.

[21] Appl. No.: 290,664

[22] Filed: Aug. 6, 1981

[51] Int. Cl.[3] ..... H01R 13/68

[52] U.S. Cl. ..... 339/88 R; 337/213; 339/147 R

[58] Field of Search ..... 337/248, 213; 339/88 R, 339/147 R, 147 P

[56] References Cited

U.S. PATENT DOCUMENTS 2,860,315 11/1958 Scagnelli .
3,132,224 5/1964 Bulein .
3,299,236 1/1967 Barker .
3,356,806 12/1967 Urani ..... 339/147 R X
3,629,808 12/1971 Andreaggi ..... 339/147 R X
3,659,252 4/1972 Brown ..... 339/147 R X

FOREIGN PATENT DOCUMENTS 1159999 7/1969 United Kingdom ..... 339/147 R
2067852 7/1981 United Kingdom ..... 339/147 R

*Primary Examiner*—Mark Rosenbaum
*Attorney, Agent, or Firm*—David R. Padnes

[57] ABSTRACT

An improved fuse cap (11) which grasps an end of an elongated fuse (13) and mates with a fuse block (12) is disclosed. The fuse cap comprises a spring-loaded electrical terminal structure (32) which can be readily assembled into the fuse cap housing (31). The terminal structure serially connects the fuse element between the terminals (24,28) in the fuse block and provides connection to an alarm terminal (25) in the block when the fuse overloads.

12 Claims, 4 Drawing Figures

FUSE BLOCK ASSEMBLY

TECHNICAL FIELD

The present invention relates to circuit controlling devices and, more particularly, to a fuse block assembly.

BACKGROUND OF THE INVENTION

A fuse block assembly provides a receptacle for one or more fuse elements. Each assembly comprises a fuse block having one or more fuse-receiving cavities and one or more removeable fuse caps which engage with the cavities. The required electrical connection of each fuse element between a power source and protected circuitry is provided by an electrical contact structure in each cap and fuse-receiving cavity. This contact structure is spring loaded to maintain the required connections under rather severe environmental conditions.

In telecommunications applications, it is also necessary to provide each fuse mounting position with the ability to activate alarm circuitry when the retained fusible element overloads or "blows". Furthermore, since multiple numbers of mounting positions are often disposed in close proximity to one another, it is also desirable that visual indication of the particular "blown" fuse be provided. Such an indication substantially reduces the time to locate the problem and restore the protected circuitry to service.

A fuse block assembly providing all of the above-described capabilities is disclosed in U.S. Pat. No. 3,299,236 to T. H. Barker, issued Jan. 17, 1967. The problem with the referenced assembly is that it is not readily repairable in the field. In particular, the electrical terminal structure within each fuse block cavity, which is the most failure-prone assembly component, cannot be replaced without complete fuse block replacement. Such replacement is time consuming and on multiple fuse block assemblies necessitates disconnecting large numbers of functioning circuits. In addition, the disclosed design requires an expensive manufacturing procedure.

SUMMARY OF THE INVENTION

In accordance with the present invention, an improved and field-repairable fuse block assembly is achieved. This improvement is achieved by the use of an electrical terminal structure which incorporates the most failure-prone elements within the removeable and easily-replaceable fuse cap. The electrical terminal structure is also readily assembled into the fuse cap housing and is also replaceable.

A feature of the present invention is that it is compatible with both individual and multiple cavity fuse blocks.

DETAILED DESCRIPTION

Figure 1:
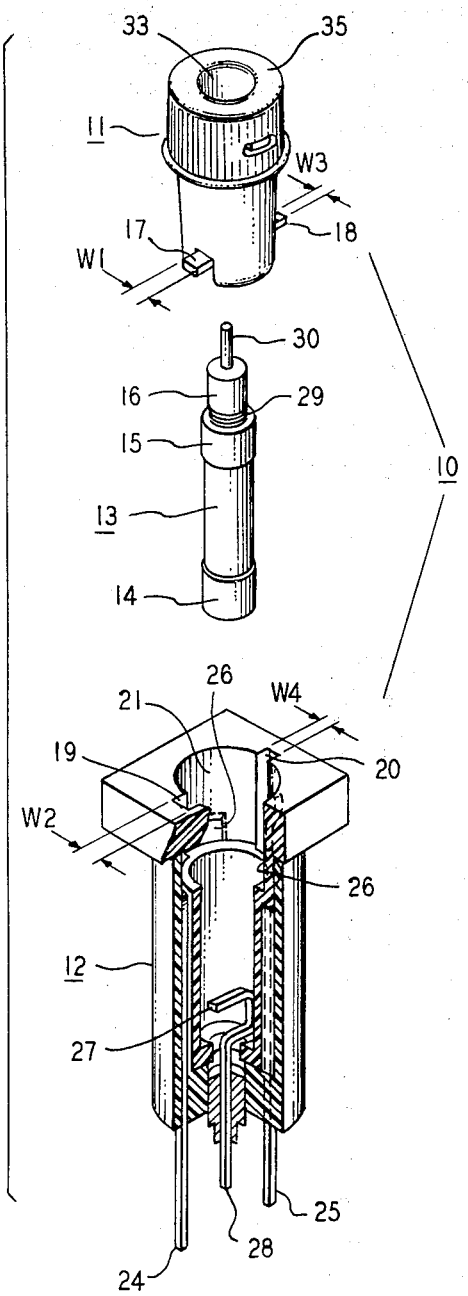
FIG. 1 is an exploded perspective view of the disclosed embodiment of the present invention.
Figure 2:
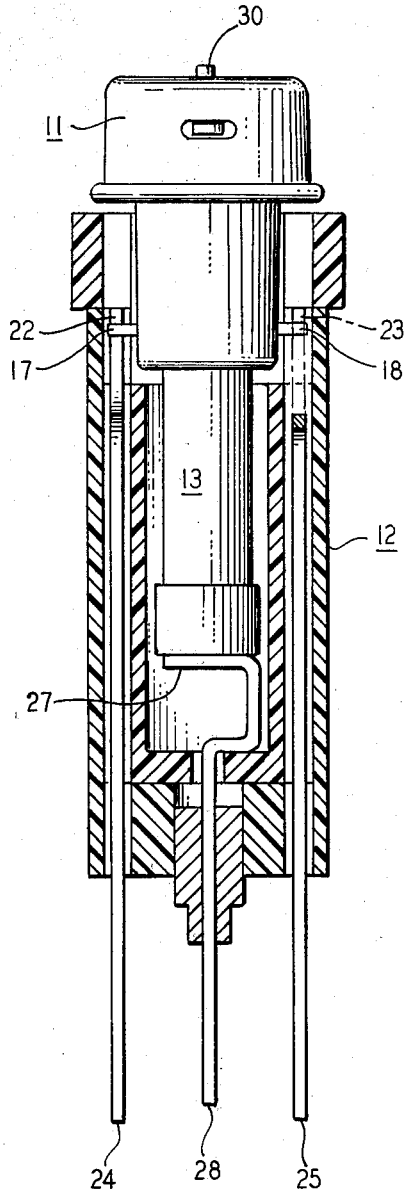
FIG. 2 is a partial cross-sectional view of the disclosed embodiment.

FIGS. 1 and 2 show an illustrative fuse block assembly 10 in accordance with the present invention. Assembly 10, comprising fuse cap 11 and fuse block 12, provides an enclosure for prior art fuse element 13 when cap 11 is engaged with block 12. This engagement is achieved by first inserting fuse element 13 within cap 11. As will be shown, the contact assembly within cap 11 grips intermediate electrically conductive portion 15 of element 13 and provides a continuous electrical path between portion 15 and extending power terminal tab 17. The cap and retained fuse element 13, with end 14 extending from the former, are then inserted into chamber 21 of fuse block 12. During insertion, extending tabs 17 and 18 on cap 11 respectively pass through diametrically opposing keyways 19 and 20 which extend downwardly along the periphery of cavity 21. In their downward passage, keyways 19 and 20 each bypass the ends 22,23 of terminals 24,25 and terminate in an offset recess 26 directly below ends 22 and 23. Thus, fuse cap 11 with retained fuse element 13 can be inserted into block 12 until tabs 17,18 pass below the level of terminal ends 22,23 and then can be twisted so that tabs 17,18 can each fit into an offset recess. When so inserted, the contact assembly within cap 11 is compressed to seat tabs 17,18 against ends 22,23, respectively to form electrical contacts. In addition, an electrical connection is formed between conductive end 14 of fuse element 13 and end 27 of center terminal 28.

It is preferable that the assembly of fuse cap and block be polarized. Such polarization insures the engagement of tab 17 to only end 22 and tab 18 to only end 23. In FIG. 1, for example, the widths W1, W2 of tab 17 and keyway 19 are wider than the widths W3, W4 of tab 18 and keyway 20. Accordingly, tab 17 can only be inserted into keyway 19.

Fuse element 13 comprises a fusible, electrically conductive link which extends interiorly from conductive end 14 through intermediate conductive portion 15 and spring 29 to conductive end 16. Accordingly, when cap 11, fuse element 13 and block 12 are assembled, as shown in FIG. 2, an electrical path is formed from terminal 24 to center terminal 28. The length of the conductive link within fuse element 13 slightly compresses spring 29 to maintain a preselected distance between portion 15 and end 16. Conductive end 16 has a smaller diameter than portion 15 and, in normal operation, is electrically isolated from any other conductive material. However, when fuse element 13 overloads or "blows", the fusible link is severed and spring 29 pushes end 16 and indicator 30 away from portion 15.

On circuit overload, the displacement of end 16 establishes an electrical contact between end 16 and a portion of the fuse cap terminal structure electrically connected to alarm tab 18. Consequently, when fuse element 13 "blows", the electrical connection between terminals 24 and 28 is broken and an electrical connection between terminals 24 and 25 is established. The latter connection can advantageously be used to couple a source of power that is connected to terminal 24 to an alarm circuit that is coupled to terminal 25. In addition, a visual indication of the overload fuse element is provided by the extension of indicator 30 of element 13 through aperture 33 of cap 11. During the normal supply of power through the fusible link of element 13, indicator 30 is substantially flush with the far end 35 of cap 11.

Figure 3:
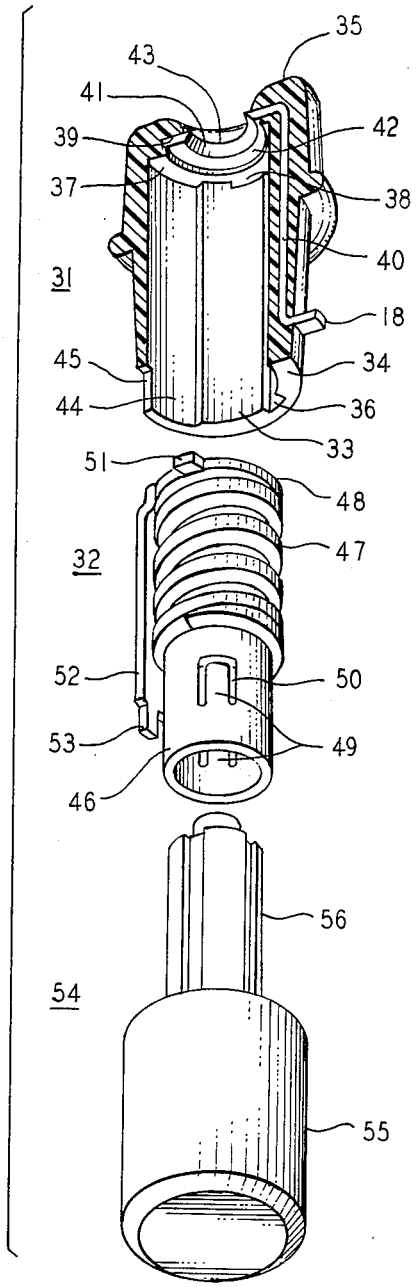
FIG. 3 is an exploded perspective view of the fuse cap shown in FIGS. 1 and 2.

Refer now to FIG. 3. Fuse cap 11 comprises a housing 31 and contact assembly 32. Housing 31 has an aperture 33 which extends from contact assembly receiving end 34 to far end 35. A pair of diametrically opposing slots 36 (only one of which is shown) intersects aperture 33. Each slot extends from end 34 to protrusion 37 and then terminates in an offset recess 38. Each offset recess 38 extends completely through the walls of housing 31. Such extension of offset recess 38 facilitates the molding of housing 31. A second protrusion 39 parallel to protrusion 37 and toward far end 35 forms a reference position for electrically conductive alarm terminal 40. Terminal 40 has an annular portion 41, extending into aperture 33, that is connected to alarm terminal tab 18. The function of annular portion 41 is to form an electrical contact with fuse end 16 when fuse element 13 "blows". At all other times, alarm terminal 40 is electrically isolated from contact assembly 32 and fuse element 13. Housing 31 is preferably molded with alarm terminal 40 therein. To facilitate this operation, the opposite surfaces 42 and 43 of annular portion 41 extend into aperture 33. This allows the use of a core insert during molding which contacts surfaces 42 and 43 to preclude the accumulation of mold material thereon. Without the use of such a core insert, any accumulation of mold material on surface 42 must be manually removed to insure a reliable electrical connection between fuse element end 16 and surface 42 of annular portion 41.

Aperture 33 also incorporates a keyway 44 which extends from end 34 to protuberance 37. Keyway 44 also intersects a second slot 45 which extends from end 34 to a position substantially opposite extending alarm terminal tab 18.

Contact assembly 32 comprises a socket 46, spring member 47 and planar base member 48. Socket 46 advantageously is a continuous open-ended cylinder of electrically conductive material. A pair of fingers 49 provide a firm grip on intermediate conductive portion 15 of fuse element 13. Each finger extends inwardly from cutouts 50 in socket 46.

Base member 48 is electrically connected to socket 46 by spring member 47. A pair of opposing tabs 51 extend from base member 48 and are substantially perpendicular to the longitudinal axis of assembled socket 46 and spring member 47. Each of the tabs 51 is sized to be receivable by one of the slots 36 and intersecting recesses 38. Power terminal 52 also extends from base 48 to a free end 53. The point of affixation of power terminal 52 to base 48 is selected to insure that when tabs 51 are inserted within slots 36, power terminal 52 is aligned with keyway 44.

Contact assembly 32 is readily assembled into housing 31 by aligning tabs 51 with the slots 36. The assembly is then inserted into aperture 33 until base 48 is adjacent to protuberance 37. The assembly is then rotated to engage each of the tabs 51 with an offset recess 38. To prevent future rotational movement during use, free end 53 of power terminal 52 is bent 90 degrees to engage with slot 45. The portion of free end 53 extending perpendicularly from housing 31 forms tab 17. The insertion and rotation of contact assembly 32 can be performed during manufacture or in the field with the use of tool 54. Tool 54 comprises a knob 55 and an extension 56 which is inserted into socket 46 and grips the same.

Figure 4:
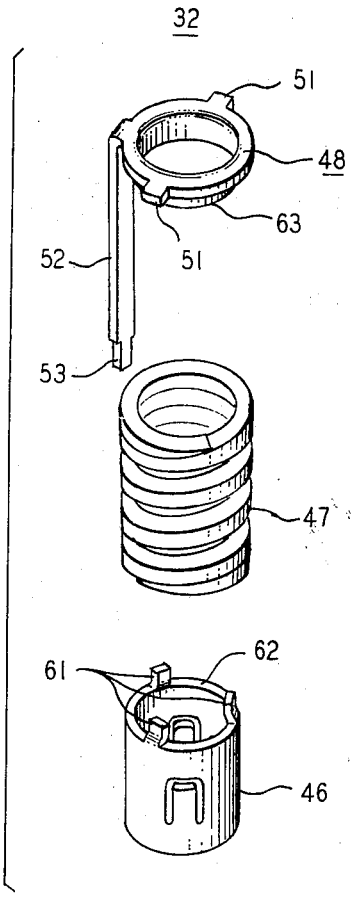
FIG. 4 is an exploded perspective view of the contact assembly shown in FIG. 3.

Contact assembly 32 is assembled as shown in FIG. 4. Socket 46 is formed with three spaced fingers 61 which extend inwardly at a slight angle from end 62. Each finger is conductively joined to the inner circumferential walls of spring member 47. Similarly, to facilitate the positioning and assembly of base member 48 to spring member 47, a raised lip 63 is formed on base member 48. Lip 63, which extends from the inner circumferential walls of base member 48, is conductively joined to the inner circumferential walls of spring member 47. Accordingly, a reliable, readily manufacturable electrical connection is established through the entire contact assembly.

It will, of course, be understood that while the above description relates to a fuse block assembly for a single fuse element, the present invention is equally applicable to fuse block assembly wherein block 12 incorporates a plurality of fuse receiving cavities.

It should also be noted that fuse cap 11 can be utilized to rehabilitate existing fuse mounting positions shown in the previously referenced U.S. Pat. No. 3,299,236. In such applications, the spring element in cap 11 compensates for any fatigued spring loaded terminals in the fuse-receiving cavities.

What is claimed is:

1. In a fuse block assembly comprising a fuse block having at least one fuse receiving chamber (e.g. 21), bus bars (e.g. 24,25) in said fuse block each having a portion (e.g., 22 or 23) which extends transversely into each of said chambers, electrical terminal means (e.g. 27) within each of said chambers for contacting an end (e.g. 14) of each inserted fuse and one removeable fuse cap (e.g. 11) positioned in one of said chambers by the engagement of first and second opposing conductive lugs (e.g. 17, 18) with said portion of said bus bars, said fuse cap being characterized by a housing (e.g. 31) having an aperture extending from a first end, said aperture defining first and second protuberances (e.g. 37,39) which extend transversely into said aperture, said first protuberance being closer to said first end, said aperture incorporating a pair of opposing recesses (e.g. 38) adjacent said first protuberance and toward said first end, said aperture also incorporating a slot (e.g. 45) extending from said first end completely through the housing wall;

a conductive base (e.g. 48) having a pair of opposing tabs (e.g. 51) which maintain the position of said base adjacent said first protuberance by the engagement of said tabs with said opposing recesses;

a conductive spring member (e.g. 47) attached to said base and extending within said aperture toward said first end;

a conductive fuse holder (e.g. 46) attached to said spring member having an opening toward said first end for receiving a second end (e.g. 16) of each inserted fuse;

a conductive first member (e.g. 52) attached to said base and having a portion (e.g. 53) which engages with said slot and forms said first lug; and a conductive second member (e.g. 40) adjacent said second protuberance and extending transversely into said aperture, said second member also extending outwardly from said housing to form said second lug.

2. The fuse block assembly of claim 1 wherein said aperture comprises a pair of diametrically opposing keyways (e.g. 36), each of said keyways extending from said first end and intersecting one of said pair of opposing recesses.

3. The fuse block assembly of claim 2 wherein said aperture extends from said first end to a second end of said fuse cap opposite said first end.

4. The fuse block assembly of claim 3 wherein said second member has parallel surfaces which extend transversely into said aperture.

5. The fuse block assembly of claim 4 wherein said base has an extending conductive lip (e.g. 63) which engages with said spring member.

6. The fuse block assembly of claim 5 wherein said fuse holder has a plurality of extending conductive fingers (e.g. 61) which engage with said spring member.

7. A fuse cap for grasping an end of an elongated fuse, said fuse cap having first and second outwardly extending and opposing lugs, characterized by a housing (e.g. 31) having an aperture extending from a first end, said aperture defining first and second protuberances (e.g. 37,39) which extend transversely into said aperture, said first protuberance being closer to said first end, said aperture incorporating a pair of opposing recesses (e.g. 38) adjacent said first protuberance and toward said first end, said aperture also incorporating a slot (e.g. 45) extending from said first end completely through the housing wall;

a conductive base (e.g. 48) having a pair of opposing tabs (e.g. 51) which maintain the position of said base adjacent said first protuberance by the engagement of said tabs with said opposing recesses;

a conductive spring member (e.g. 47) attached to said base and extending within said aperture toward said first end;

a conductive fuse holder (e.g. 46) attached to said spring member having an opening toward said first end for grasping said fuse end (e.g. 16);

a conductive first member (e.g. 52) attached to said base and having a portion (e.g. 53) which engages with said slot and forms a first lug which outwardly extends from said housing; and a conductive second member (e.g. 40) adjacent said second protuberance and extending transversely into said aperture, said second member also extending outwardly from said housing to form a second lug which outwardly extends from said housing opposite said first lug.

8. The fuse cap of claim 7 wherein said aperture comprises a pair of diametrically opposing keyways (e.g. 36), each of said keyways extending from said first end and intersecting one of said pair of opposing recesses.

9. The fuse cap of claim 8 wherein said aperture extends from said first end to a second end of said fuse cap opposite said first end.

10. The fuse cap of claim 9 wherein said second member has parallel surfaces which extend transversely into said aperture.

11. The fuse cap of claim 10 wherein said base has an extending conductive lip (e.g. 63) which engages with said spring member.

12. The fuse cap of claim 11 wherein said fuse holder has a plurality of extending conductive fingers (e.g. 61) which engage with said spring member.

* * * * *